US007802547B2

(12) United States Patent
Inomoto et al.

(10) Patent No.: US 7,802,547 B2
(45) Date of Patent: Sep. 28, 2010

(54) INTERNAL COMBUSTION ENGINE HAVING VARIABLE VALVE OPERATING DEVICE

(75) Inventors: Yutaka Inomoto, Saitama (JP); Masahiro Kuroki, Saitama (JP)

(73) Assignee: Honda Motor Co., Ltd., Tokyo (JP)

( * ) Notice: Subject to any disclaimer, the term of this patent is extended or adjusted under 35 U.S.C. 154(b) by 553 days.

(21) Appl. No.: 11/889,147

(22) Filed: Aug. 9, 2007

(65) Prior Publication Data

US 2008/0035083 A1 Feb. 14, 2008

(30) Foreign Application Priority Data

Aug. 11, 2006 (JP) ..... 2006-219699

(51) Int. Cl.
*F01L 1/34* (2006.01)

(52) U.S. Cl. ..... 123/90.16; 123/90.31; 123/90.39; 74/559

(58) Field of Classification Search ..... 123/90.15, 123/90.16, 90.17, 90.18, 90.27, 90.31, 90.39, 123/90.44; 74/559, 567, 569
See application file for complete search history.

(56) References Cited

U.S. PATENT DOCUMENTS 6,202,611 B1 3/2001 Regueiro
6,318,316 B1 11/2001 Tsukui et al.
6,920,852 B2 * 7/2005 Machida ..... 123/90.16
7,017,551 B2 * 3/2006 Shimizu ..... 123/399
7,497,192 B2 * 3/2009 Yamada et al. ..... 123/90.16

FOREIGN PATENT DOCUMENTS

| | | |
|---|---|---|
| JP | 11-336515 | 12/1999 |
| JP | 2000-291419 A | 10/2000 |
| JP | 2002-70596 A | 3/2002 |
| JP | 2004-27865 A | 1/2004 |
| JP | 2005-180327 | 7/2005 |
| JP | 2005-207254 A | 8/2005 |
| JP | 2005-207255 A | 8/2005 |
| JP | 2005-233180 | 9/2005 |

* cited by examiner

*Primary Examiner*—Ching Chang
(74) *Attorney, Agent, or Firm*—Birch, Stewart, Kolasch & Birch, LLP

(57) ABSTRACT

To effectively arrange actuators for control by individually controlling an intake valve and an exhaust valve in an internal combustion engine which includes a variable valve operating device for controlling valve operating characteristics. An internal combustion engine includes a variable valve operating device having a valve characteristic variable mechanism for controlling valve operating characteristics of engine valves consisting of an intake valve and an exhaust valve. The valve characteristic variable mechanism includes electrically operated motors for changing operational timings and lift quantities of the above-mentioned engine valves. The electrically operated motors are arranged outside a valve operating chamber. At the same time, the electrically operated motors are arranged close to the throttle body on a cylinder intake side.

27 Claims, 10 Drawing Sheets

INTERNAL COMBUSTION ENGINE HAVING VARIABLE VALVE OPERATING DEVICE

CROSS-REFERENCE TO RELATED APPLICATIONS

The present application claims priority under 35 USC 119 to Japanese Patent Application No. 2006-219699 filed on Aug. 11, 2006 the entire contents of which are hereby incorporated by reference.

BACKGROUND OF THE INVENTION

1. Field of the Invention

The present invention relates to an internal combustion engine having a variable valve operating device.

2. Description of Background Art

An internal combustion engine which is mounted on a vehicle is known wherein a valve operating mechanism is provided on a cylinder head with a valve characteristic variable mechanism for controlling the respective operational timings and maximum lift quantities of an intake valve and an exhaust valve. See, for example, JP-A-2005-207254, JP-A-2005-207255, JP-A-2004-27865, JP-A-2002-70596 and JP-A-2000-291419.

The valve characteristic variable mechanism includes a single actuator, an electrically operated motor, a hydraulic cylinder or the like, as a drive source corresponding to the intake and exhaust valves. Since the actuator becomes bulky or takes a relatively large space, the actuator is usually arranged outside a valve operating chamber separately from respective parts of the mechanism.

In the above-mentioned internal combustion engine, to efficiently make use of an EGR (Exhaust Gas Recirculation) combustion range having a favorable fuel economy by properly setting a valve overlap quantity or the like in response to an operational state (under a loaded state), it is desirable to individually control intake and exhaust sides of a valve operating device. However, in such a case, it is necessary to sufficiently study a layout of the actuator which is liable to take a large space.

SUMMARY AND OBJECTS OF THE INVENTION

Accordingly, it is an object of an embodiment of the present invention, in an internal combustion engine having a variable valve operating device which controls valve operating characteristic thereof, to enable individual controls of an intake valve and an exhaust valve and an efficient layout of an actuator for the control.

As a means for overcoming the above-mentioned drawback, according to an embodiment of the present invention, an internal combustion engine 20 is provided which is mounted on a vehicle, for example, a motorcycle 1. The internal combustion engine 20 includes a cylinder head 24 which is joined to a cylinder body 23 and forms a combustion chamber 31 and a valve operating chamber 32. A variable valve operating device 40 is provided having a valve characteristic variable mechanism 61 for controlling a valve operating characteristic of at least one engine valve out of an intake valve 34*a* and an exhaust valve 34*b*. The valve characteristic variable mechanism includes an actuator, for example, electrically operated motors 62*a*, 62*b*, for changing at least one of the operational timing and a lift quantity of the engine valve with the actuator being arranged outside the valve operating chamber. The actuator according to an embodiment of the present invention is arranged on a cylinder intake side and, at the same time, is arranged close to a throttle body 26.

According to an embodiment of the present invention, in an internal combustion engine 20 mounted on a vehicle, for example, a motorcycle 1, and including a cylinder head 24 joined to a cylinder body 23 and forming a combustion chamber 31 and a valve operating chamber 32 therein a variable valve operating device 40 includes a valve characteristic variable mechanism 61 for controlling a valve operating characteristic of at least one engine valve out of an intake valve 34*a* and an exhaust valve 34*b*. The valve characteristic variable mechanism includes an actuator, for example, electrically operated motors 62*a*, 62*b*, for changing at least one of the operational timing and a lift quantity of the engine valve. In addition, the actuator is arranged outside the valve operating chamber wherein a drive axis C3 of the actuator is arranged substantially orthogonal to a cylinder axis C1.

According to an embodiment of the present invention, in an internal combustion engine 20 mounted on a vehicle, for example, a motorcycle 1, and including a cylinder head 24 joined to a cylinder body 23 and forming a combustion chamber 31 and a valve operating chamber 32 therein a variable valve operating device 40 includes a valve characteristic variable mechanism 61 for controlling a valve operating characteristic of at least one engine valve out of an intake valve 34*a* and an exhaust valve 34*b*. The valve characteristic variable mechanism includes an actuator, for example, electrically operated motors 62*a*, 62*b*, for changing at least one of the operational timing and a lift quantity of the engine valve. The actuator includes a plurality of actuators for individually controlling the intake valve and the exhaust valve, and a cylinder intake passage is arranged in a space surrounded by the plurality of actuators as viewed in the direction of the cylinder axis.

According to an embodiment of the present invention, the valve characteristic variable mechanism includes control shafts 65*a*, 65*b* which are rotated to change at least one of the operational timing and the lift quantity of the engine valve. A sensor, for example, an angle sensor 86, is provided for detecting a rotational angle that is mounted on one end portion of the control shaft.

According to an embodiment of the present invention, at least one of the operational timing and the lift quantity of the engine valve is controlled in response to the throttle opening and an engine rotational speed.

According to an embodiment of the present invention, the actuator is driven in response to the throttle opening and the engine rotational speed.

According to an embodiment of the present invention, the throttle opening is obtained based on an output of an opening sensor of an electronic throttle.

According to an embodiment of the present invention, by effectively making use of a space which is liable to be easily formed around the intake system parts, particularly, around the throttle body which connects the cylinder head and an air cleaner, it is possible to arrange the actuator which is liable to easily become bulky. Thus, even when the internal combustion engine includes the plurality of actuators, it is possible to miniaturize the whole internal combustion engine and to enhance the cooling property of the actuator.

According to an embodiment of the present invention, it is possible to suppress the projection of the actuator from the cylinder head in the cylinder axis direction. Thus, even when the internal combustion engine includes the plurality of actuators, it is possible to miniaturize the whole cylinder in the cylinder axis direction.

According to an embodiment of the present invention, by individually changing the operational timings and the lift quantities of the intake valve and the exhaust valve, it is possible to efficiently make use of an EGR combustion range exhibiting a favorable fuel economy. Further, it is possible to effectively arrange the respective actuators and the cylinder intake passage.

According to an embodiment of the present invention, by directly detecting a rotational angle of a controls shaft using the sensor, it is possible to easily adjust the operational timing and the lift quantity of the engine valve.

According to an embodiment of the present invention, it is possible to set a suitable EGR combustion zone in response to the throttle opening and the engine rotational speed and, at the same time, it is possible to enhance the reduction of the fuel economy by optimizing the EGR combustion range.

According to an embodiment of the present invention, in an electronic throttle type engine, by obtaining the throttle opening based on an output of an opening sensor of the throttle valve, it is possible to realize the more accurate engine control and, at the same time, the increase of the number of parts can be suppressed.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

Figure 1:
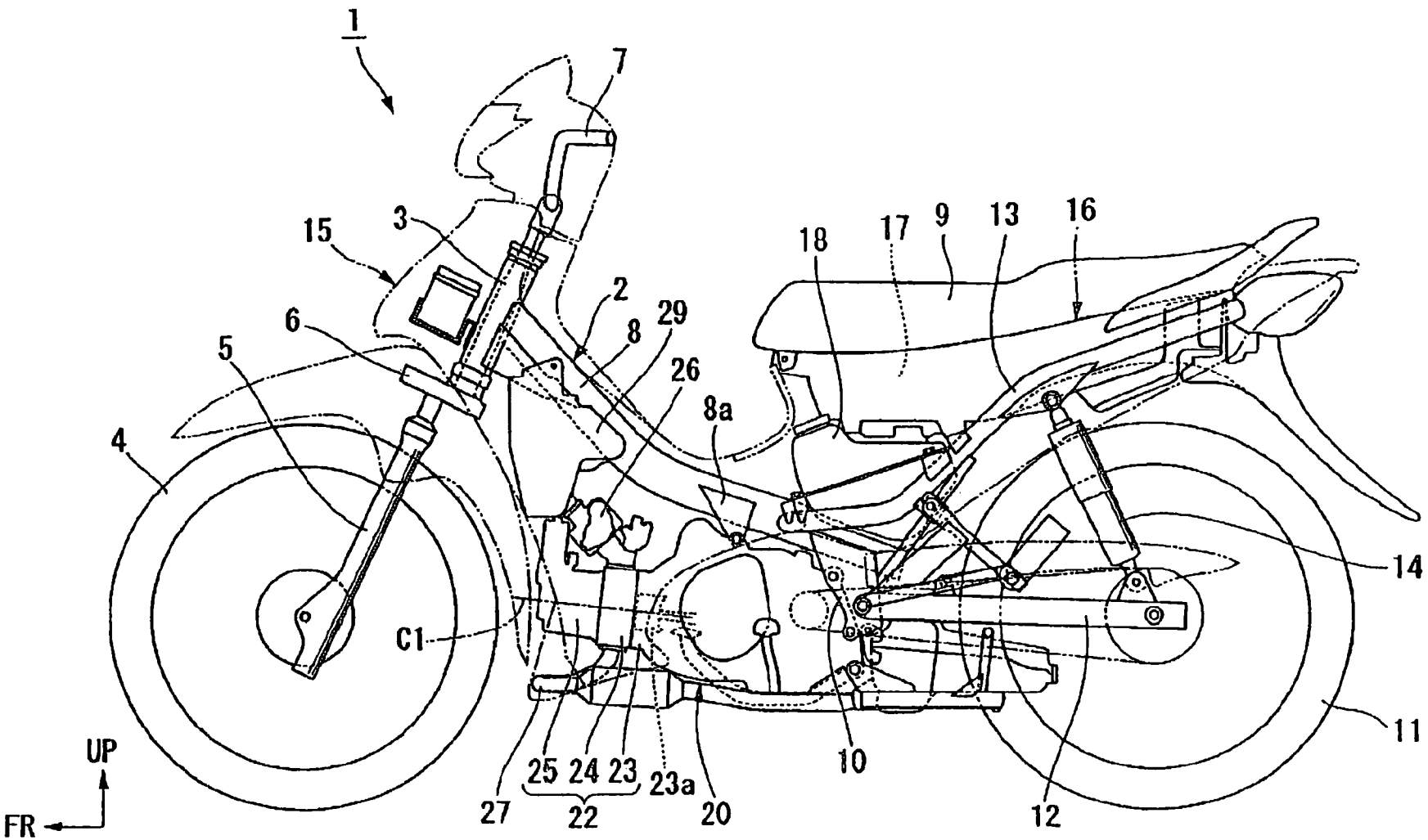
FIG. 1 is a left side view of a motorcycle according to an embodiment of the present invention.

Hereinafter, embodiments of the present invention are explained in conjunction with the drawings. In the explanation made hereinafter, the directions of front, rear, left, right and the like are, unless otherwise specified, equal to directions of the vehicle. Further, in the drawing, an arrow FR indicates the frontward direction of the vehicle, an arrow LH indicates the leftward direction of the vehicle, and an arrow UP indicates the upward direction of the vehicle respectively.

In a motorcycle 1 shown in FIG. 1, left and right front forks 5 pivotally support a front wheel 4 that is steerably supported on a head pipe 3 which is positioned on a front end portion of a vehicle body frame 2 by way of a steering stem 6. A bar handle 7 for steering is mounted on an upper portion of the steering stem 6. A right grip portion of the bar handle 7 forms a throttle grip.

The vehicle body frame 2 is of a so-called backbone type in which one main tube 8 extends rearwardly and downwardly in an inclined manner from the head pipe 3 thus forming a lower portion between the head pipe 3 and a rider's seat 9. Such a constitution allows a rider to easily stride over the seat 9. Left and right pivot plates 10 are joined to a rear end portion of the main tube 8, and front end portions of swing arms 12 which pivotally support a rear wheel 11 are pivotally and rockably supported on the left and right pivot plates 10.

Front end portions of left and right seat frames 13, which extend rearwardly and upwardly in an inclined manner, are joined to a rear portion of the main tube 8, and left and right rear shock absorbers 14 are arranged between intermediate portions of the left and right seat frames 13 in the longitudinal direction and rear end portions of left and right arms of the swing arms 12. The seat 9 is arranged above the left and right seat frames 13. Here, the seat 9 has a seat surface for a driver and a seat surface for a pillion in the longitudinal direction.

A front portion of the vehicle body frame 2 is suitably covered with a front vehicle body cover 15 made of a synthetic resin, while a rear portion of the vehicle body frame 2 is suitably covered with a rear vehicle body cover 16 also made of a synthetic resin. The rear vehicle body cover 16 supports the seat 9 together with the left and right seat frames 13. An article storing box 17, which is positioned below the seat 9, is arranged in the inside of the rear vehicle body frame 2. A fuel tank 18 is provided which is supported on front portions of the left and right seat frames 13 are arranged on a front lower side of the article storing box 17.

An engine (internal combustion engine) 20, which constitutes a prime mover of the motorcycle 1, is arranged in the inside of the center lower portion (inside of the lower portion) of the vehicle body frame 2. The engine 20 is an air-cooled single-cylinder engine which arranges a crankshaft thereof not shown in the drawing along the vehicle width direction (lateral direction) and has a basic constitution which mounts a cylinder portion 22 in an erected manner from a front end portion of a crankcase 21 thereof to the front side of the vehicle. In the engine 20, upper and lower rear portions of the crankcase 21 are supported on the left and right pivot plates 10 and, at the same time, an upper portion of the crankcase 21 is supported on a longitudinally intermediate portion of the main tube 8 by way of an engine hanger 8*a*.

A cylinder portion 22 of the engine 20 frontwardly projects from the front end portion of the crankcase 21 (in the vehicle advancing direction) with an axis thereof (cylinder axis) C1 arranged approximately horizontal (slightly frontwardly and upwardly in detail) with respect to a ground surface. The cylinder portion 22 is mainly formed of a cylinder body 23 which is mounted on the front end portion of the crankcase 21, a cylinder head 24 which is mounted on a front end portion of the cylinder body 23, and a head cover 25 which is mounted on a front end portion of the cylinder head 24. A piston 23*a* is fitted in the inside of the cylinder body 23, and a reciprocation motion of the piston 23*a* is converted into a rotary motion of the crankshaft.

Figure 2:
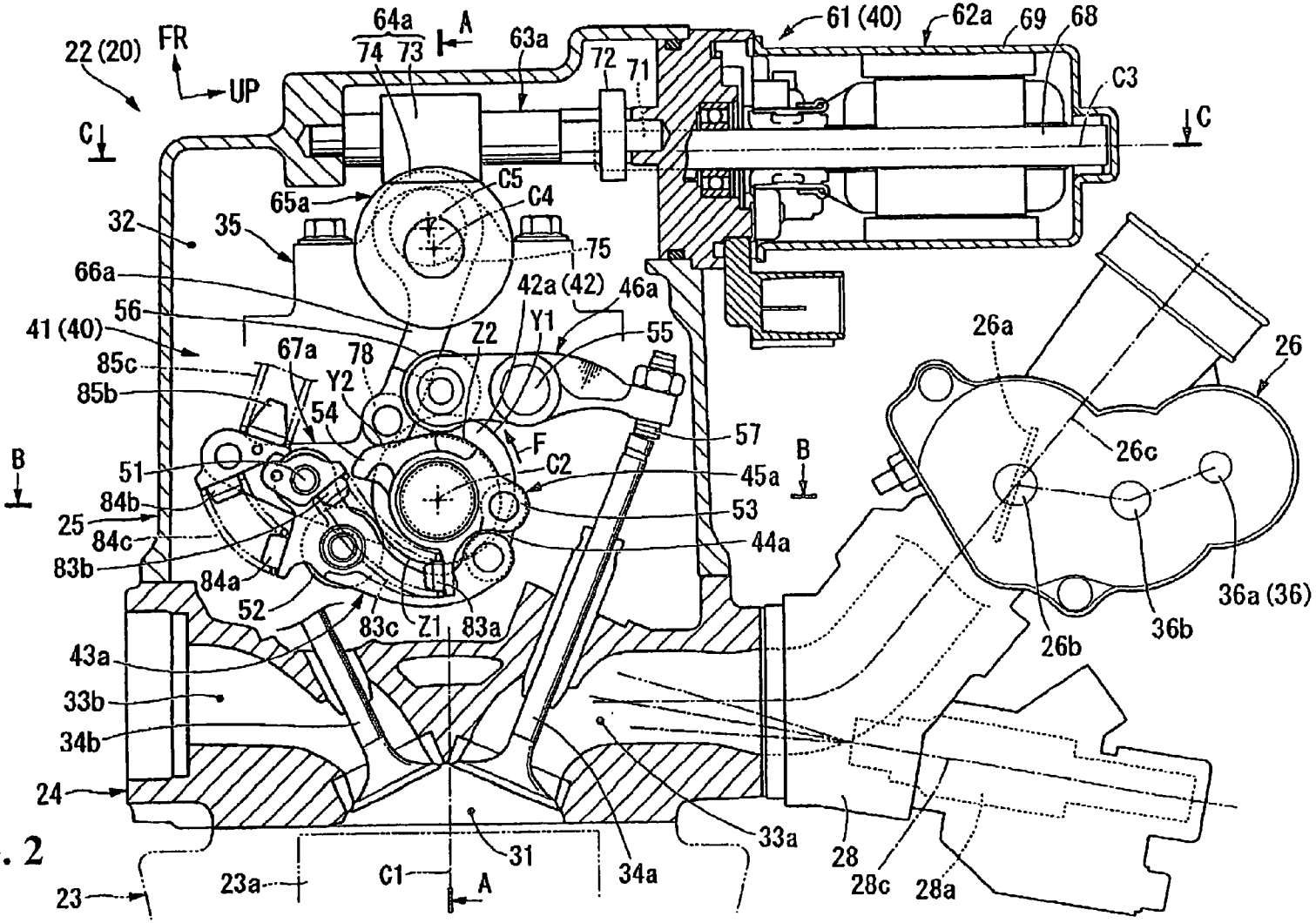
FIG. 2 is a cross-sectional view of surrounding of a cylinder head of an engine of the above-mentioned motorcycle.

To explain the embodiment also in conjunction with FIG. 2 along with FIG. 1, a downstream side of a throttle body 26 is connected to the upper side (intake side) of the cylinder head 24 by way of an insulator 28 and, at the same time, a proximal end side of an exhaust pipe 27 is connected with the lower side (exhaust side) of the cylinder head 24. The throttle body 26 has an intake passage therein arranged in a downwardly inclined manner, and a rear end side (downstream side) thereof connected to the cylinder head 24 by way of the insulator 28 which is curved toward a lower side (cylinder side).

A throttle valve (a butterfly valve) 26*a* of the throttle body 26 is an electronic throttle which is operated by a driving force of an electric motor 36 which is driven in accordance with a manipulation quantity of the throttle grip (an output requirement from a rider) or the like. In FIG. 2, a rotation shaft 26*b* of the throttle valve 26*a* is provided together with an output shaft 36*a* of the electric motor 36. A reduction gear shaft 36*b* is arranged between the output shaft 36*a* and the rotation shaft 26*b*. Further, an opening sensor not shown in FIG. 2 for detecting an opening of the throttle valve 26*a* is provided to the rotation shaft 26*b*.

An air cleaner case 29 is supported on a front lower side of the main tube 8 and is connected to an upstream side (front end side) of the throttle body 26. An injector (a fuel injection valve) 28*a* is mounted on a curved outer peripheral side of the insulator 28 from above. In FIG. 2, a line 26*c* indicates an axis of the intake passage in the inside of the throttle body 26, and a line 28*c* indicates a center axis (an axis along the fuel injection direction) of the injector 28*a*, respectively.

The cylinder head 24 forms a combustion chamber 31 together with the cylinder body 23 and the piston 23*a* and also forms a valve operating chamber 32 together with the head cover 25. The engine 20 in this embodiment is an OHC two-valve-type engine, wherein an intake port 33*a* and an exhaust port 33*b* each of which has a single combustion-chamber-side opening are respectively formed in the cylinder head 24, and the combustion-chamber-side openings of respective ports 33*a*, 33*b* are opened or closed by an intake valve 34*a* and by an exhaust valve 34*b*, hereinafter, these valves are also referred to as engine valves.

The respective engine valve 34*a*, 34*b* include umbrella-like valve bodies which are aligned with combustion-chamber-side openings of the respective ports 33*a*, 33*b* and rod-like stems which are extended from the valve bodies. The stems of the respective engine valves 34*a*, 34*b* extend obliquely in a state wherein the stems move away from each other toward the head cover 25 side (toward the inside of the valve operating chamber 32) and form a V-shape in a side view, and are supported in a reciprocally penetrating manner on a valve guide which is fixedly mounted on the cylinder head 24. A spring force of a valve spring is imparted via a retainer (neither one of these parts is shown in the drawing) in the stem distal end side of the respective engine valve 34*a*, 34*b*. The valve bodies of the respective engine valves 34*a*, 34*b* close the combustion chamber side openings of the respective ports 33*a*, 33*b* due to the spring force. On the other hand, by operating the respective engine valves 34*a*, 34*b* against the spring force, the valve bodies of the respective engine valves 34*a*, 34*b* open the combustion-chamber-side openings of the respective ports 33*a*, 33*b*.

The intake valve 34*a* is opened in an intake stroke in which the piston 23*a* descends toward the crankcase 21 side thus allowing outside air to be sucked in the inside of the cylinder through the air cleaner case 29 and the throttle body 26. Thus, the outside air is mixed with a fuel injected from the injector 28*a* in the inside of the intake port 33*a* and is sucked into the combustion chamber 31. Next, in a compression stroke in which the piston 23*a* ascends toward the cylinder head 24 side, the intake valve 34*a* is closed and the mixed air which is sucked into the combustion chamber 31 is compressed and, at the same time, the mixed air is ignited by two ignition plugs 31*a*, 31*b* and is burnt. See FIG. 3.

Next, in an expansion stroke in which the piston 23*a* descends again, the piston 23*a* applies a torque to the above-mentioned crankshaft upon receiving a combustion gas pressure in the inside of the combustion chamber 31. Thereafter, the exhaust valve 34*b* is opened in an exhaust stroke in which the piston 23*a* ascends again thus allowing a burnt gas in the inside of the combustion chamber 31 to be discharged to the outside of the cylinder through the exhaust port 33*b* which is in communication with the combustion chamber 31.

As shown in FIG. 2, the engine 20 includes a variable valve operating device 40 which can control valve operating properties of the respective engine valves 34*a*, 34*b*.

The variable valve operating device 40 is formed by combining a valve drive mechanism 41 which opens or closes the respective engine valves 34*a*, 34*b* and a valve characteristic variable mechanism 61 which changes the valve operating properties including open/close timings and the maximum lift quantities of the respective engine valves 34*a*, 34*b*.

Figure 3:
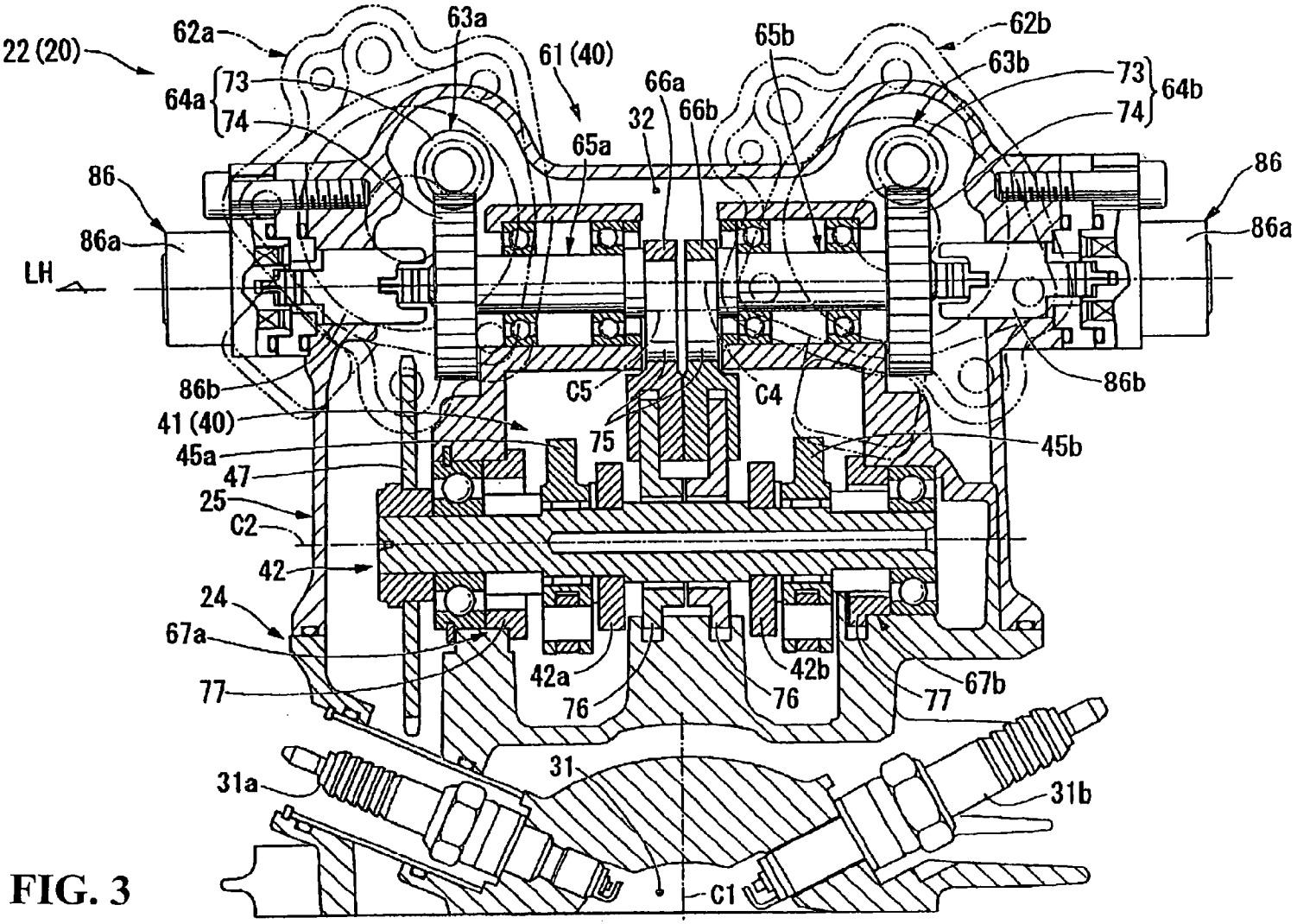
FIG. 3 is a cross-sectional view taken along a line A-A in FIG. 2.
Figure 4:
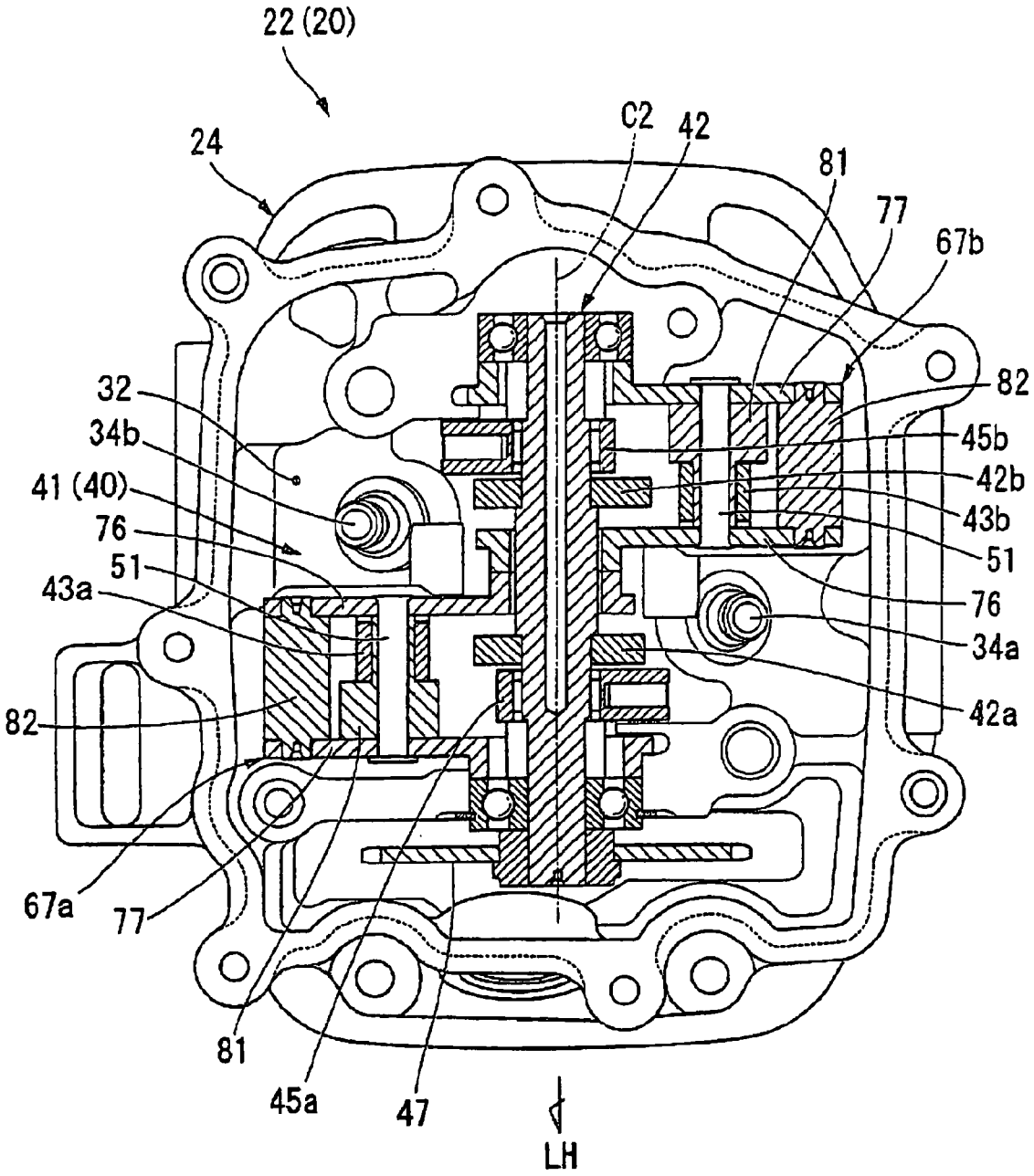
FIG. 4 is a cross-sectional view taken along a line B-B in FIG. 2.

To explain the embodiment also in conjunction with FIGS. 3 and 4 along with FIGS. 1 and 2, the valve driving mechanism 41 includes, in the inside of the valve operating chamber 32, a camshaft 42 which laterally extends in parallel with the above-mentioned crankshaft, intake and exhaust sub rocker arm 43*a*, 43*b* which are respectively rocked by an intake drive cam 42*a* and an exhaust drive cam 42*b* which are mounted on the camshaft 42, intake and exhaust rotary cams 45*a*, 45*b* which are connected to either one of the respective sub rocker arms 43*a*, 43*b* via link members 44*a*, 44*b* and are rotated by rocking movements of the respective sub rocker arms 43*a*, 43*b*, and intake and exhaust main rocker arms 46*a*, 46*b* which stride over any one of the respective rotary cams 45*a*, 45*b* and the engine valve 34*a* or 34*b*.

FIG. 2 shows the intake side of the valve drive mechanism 41. However, the sub rocker arms 43*a*, 43*b*, the link members 44*a*, 44*b*, the rotary cams 45*a*, 45*b* and the main rocker arms 46*a*, 46*b* have substantially the same constitutions on the intake side and the exhaust side respectively. See, FIGS. 7, 9. These parts are substantially arranged in a rotational symmetrical manner by 180° about the cylinder axis C1.

The camshaft 42 is arranged between stems of the respective engine valves 34*a*, 34*b* and has both left and right end portions thereof rotatably supported on the cylinder head 24 and a cam holder 35 which is fixed to the cylinder head 24. A driven sprocket wheel 47 is mounted on a left end of the camshaft 42 with a cam chain extending and wound around the driven sprocket wheel 47 and a drive sprocket wheel mounted on the crankshaft (neither one of these parts is shown in the drawing). Thus, the camshaft 42 is rotationally driven in response to the rotation of the crankshaft at a speed half of a speed of the crankshaft. In the drawing, an arrow F indicates a rotation direction (normal rotation direction) of the camshaft 42 and an axis C2 indicates a rotation axis (a cam axis) of the camshaft 42.

In an intermediate portion of the camshaft 42 in the lateral direction, for example, in order from the left, the intake drive cam 42*a* and the exhaust drive cam 42*b* are mounted in parallel with a predetermined gap therebetween. An outer peripheral surface (a cam surface) of each drive cam 42*a*, 42*b* includes a cylindrical zero lift surface Z1 which is coaxial with the camshaft 42 and a lift surface Y1 which increases a diameter thereof by bulging toward an outer peripheral side with respect to the zero lift surface Z1. Each drive cam 42*a*, 42*b* is formed such that, when an input portion of the sub rocker arm 43*a* or 43*b* is brought into contact with the zero lift surface Z1, an input portion of the main rocker arm 46*a* or 46*b* is made to be in contact with the zero lift surface Z2 of the corresponding rotary cam 45*a* or 45*b*, and the combustion-chamber-side opening of the port 33*a* or 33*b* is kept closed without lifting the corresponding engine valve 34*a* or 34*b*.

On the other hand, when an input portion of the sub rocker arm 43*a* or 43*b* gets over the lift surface Y1 of each drive cam 42*a*, 42*b*, by rocking the sub rocker arm 43*a* or 43*b*, an input portion of the main rocker arm 46*a* or 46*b* is allowed to get over the lift surface Y2 of the corresponding rotary cam 45*a* or 45*b* thus lifting the corresponding engine valve 34*a* or 34*b* whereby the combustion-chamber-side opening of the port 33*a* or 33*b* is opened.

Each sub rocker arm 43*a*, 43*b* has one end portion which constitutes a rocking fulcrum arranged on a side opposite to the corresponding engine valve 34*a* or 34*b* with a camshaft 42 sandwiched therebetween and extends toward the engine valve 34*a* or 34*b* side from the one end portion in a state wherein the sub rocker arm 43*a* or 43*b* wraps around below the camshaft 42 (the cylinder head 24 side). A distal end portion thereof is connected to the rotary cam 45*a* or 45*b* via a link member 44*a* or 44*b*. One end portion of each sub rocker arm 43*a*, 43*b* is rockably supported on a holder 67*a* or 67*b* described later by way of a shaft 51 parallel with the camshaft 42. Further, a portion of each sub rocker arm 43*a*, 43*b* closer to one end portion thereof in a longitudinally intermediate portion constitutes the above-mentioned input portion which supports a cam roller 52 which rolls on a cam surface of the drive cam 42*a* or 42*b*.

The respective rotary cams 45*a*, 45*b* are arranged on laterally outer sides of the corresponding drive cams 42*a* and 42*b*. The cams 45*a*, 45*b* are located closely to the drive cams 42*a* and 42*b*. The rotary cams 45*a*, 45*b* are supported on the camshaft 42 in a penetrating manner and are rotatable coaxially with and relative to the camshaft 42. On the engine valves 34*a*, 34*b* sides corresponding to the respective rotary cams 45*a*, 45*b*, connecting portions 53 for connecting the link members 44*a* and 44*b* are formed in a projecting manner. On the head cover 25 side of outer peripheral surfaces of the respective rotary cam 45*a*, 45*b*, cam surfaces including the above-mentioned zero lift surfaces Z2 and the lift surfaces Y2 are formed. The zero lift surfaces Z2 are formed into a cylindrical shape which is coaxial with the camshaft 42 with the lift surfaces Y2 extending toward sides opposite to the corresponding engine valve 34*a* and 34*b* along the tangential directions of the zero lift surfaces Z2 to form a curved surface which is curved toward the cylinder head 24 side while increasing a diameter size thereof. On cam crest portions 54 which form the lift surfaces Y2, portions on the sides opposite to the lift surfaces Y2 assume stepped portions which include flat portions along the camshaft diameter directions.

Each main rocker arm 46*a*, 46*b* arranges one end portion thereof which constitutes an input portion above the camshaft 42 (the head cover 25 side) and extends toward a distal end of the stem of the corresponding engine valve 34*a* or 34*b* from one end portion. A longitudinally intermediate portion of the main rocker arm 46*a*, 46*b* is rockably supported on the cam holder 35 by way of a shaft 55 arranged parallel with the camshaft 42. A cam roller 56, which rolls on a cam surface of the corresponding rotary cam 45*a* or 45*b*, is supported on the above-mentioned one end portion of each main rocker arm 46*a*, 46*b*. A tappet bolt 57 is brought into contact with a distal end of the stem of the corresponding engine valve 34*a* or 34*b* and is fixed to another end side of each main rocker arm 46*a*, 46*b*.

In such a construction, when the camshaft 42 is rotatably driven together with the crankshaft and the cam roller 52 of the sub rocker arm 43*a* or 43*b* gets over the lift surface Y1 of each drive cam 42*a*, 42*b*, the sub rocker arm 43*a* or 43*b* is rocked thus rotating the rotary cam 45*a* or 45*b* by way of the link member 44*a* or 44*b*. Then, a cam crest portion 54 of the rotary cam 45*a* or 45*b* is moved to a cam roller 56 side of the corresponding main rocker arm 46*a* or 46*b* to make the cam roller 56 of the main rocker arm 46*a* or 46*b* get over the lift surface Y2 of the cam crest portion 54. Thus, the main rocker arm 46*a* or 46*b* is rocked thus opening the engine valve 34*a* or 34*b* which is in a closed state. See FIG. 7 and FIG. 9.

Figure 5:
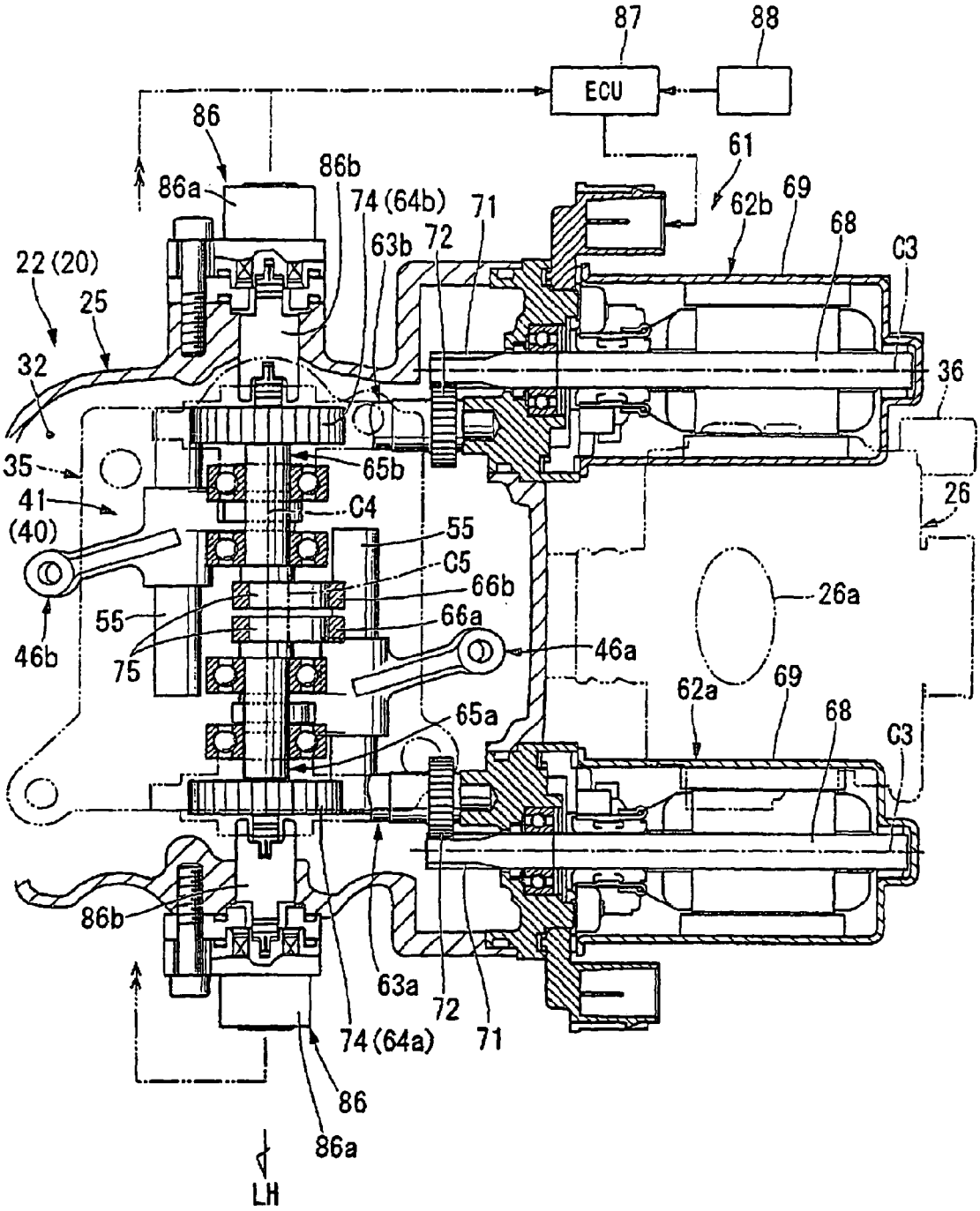
FIG. 5 is a cross-sectional view taken along a line C-C in FIG. 2.

As shown in FIG. 2, FIG. 3 and FIG. 5, the valve characteristic variable mechanism 61 includes intake-side and exhaust-side electrically operated motors 62*a*, 62*b* which constitute individual drive sources on intake and exhaust sides, intake-side and exhaust-side second drive shafts 63*a*, 63*b* to which a rotational force of either one of the electrically operated motors 62*a*, 62*b* is transmitted. A pair of intake-side and exhaust-side worm gears 64*a*, 64*b* are provided which reduce a rotational force of either one of the second drive shafts 63*a*, 63*b* and convert the rotational direction by 90°. Intake-side and exhaust-side control shafts 65*a*, 65*b* are driven by way of either one of the pair of worn gears 64*a*, 64*b*. Intake-side and exhaust-side arm members 66*a*, 66*b* have one end thereof engaged with either one of eccentric cams 75 mounted on the respective control shafts 65*a*, 65*b*, and intake-side and exhaust-side holders 67*a*, 67*b* to which either one of another end portions of the respective arm members 66*a*, 66*b* is connected.

FIG. 2 shows the intake side of the valve characteristic variable mechanism 61. However, the electrically operated motors 62*a*, 62*b*, second drive shafts 63*a*, 63*b*, the pair of worm gears 64*a*, 64*b*, and the control shafts 65*a*, 65*b* have substantially the same constructions on the intake side and the exhaust side respectively. See, FIG. 7, FIG. 9. These parts are substantially arranged in line symmetry with respect to the cylinder axis C1. Further, the arm members 66*a*, 66*b* and the holders 67*a*, 67*b* also have the substantially same construction on the intake side and the exhaust side respectively. See, FIG. 7 and FIG. 9. The above-mentioned parts are arranged in substantially rotational symmetry by 180° around the cylinder axis C1.

The respective motors 62*a*, 62*b* are arranged in parallel in the lateral direction with a predetermined distance therebetween on the intake side and the cylinder-distal-end side of the head cover 25. Drive axes (rotary axes) C3 of the drive shafts 68 are arranged substantially orthogonal to the cylinder axis C1 and the cam axis C2. At the same time, the motors 62*a*, 62*b* are mounted on the head cover 25 in a state wherein one-end side of the motors 62*a*, 62*b* in one axial direction are brought into contact with the intake side of the head cover 25. The drive shafts 68 of the respective motors 62*a*, 62*b* extend into the inside of the valve operating chamber 32, and exothermic bodies such as coils are arranged outside the valve operating chamber 32 in a state wherein the exothermic bodies are housed in the inside of substantially cylindrical cases 69 along the above-mentioned axis C3. As viewed in the direction of the cylinder axis C1, a cylinder intake passage, which includes the throttle body 26 therein, is arranged between the respective motors 62*a*, 62*b* (between the cases 69). See FIG. 5.

Respective second drive shafts 63*a*, 63*b* are arranged in parallel with the drive shafts 68 of the corresponding motors 62*a* or 62*b* on left and right sides of the cylinder distal end side in the inside of the valve operating chamber 32. Both end portions of the second drive shafts 63*a*, 63*b* are rotatably supported on the head cover 25. On motor-side end portions of the respective second drive shafts 63*a*, 63*b*, relatively-large-diameter second gears 72 are mounted that mesh with first gears 71 formed on outer peripheries of the drive shafts 68 of the motor 62*a* or 62*b*. Worm gears 73 are formed on longitudinally intermediate portions of the respective second drive shafts 63*a*, 63*b*. The worm gears 73 are meshed with wheel gears 74 which are mounted on control shafts 65*a* or 65*b* positioned on the cylinder head 24 side. Thus, without using the respective second drive shafts 63*a*, 63*b*, the drive shafts 68 of the respective motors 62*a*, 62*b* may be directly connected to pairs of the worm gears 64*a*, 64*b*.

The respective control shafts 65*a*, 65*b* extend in the inside of the valve operating chamber 32 in parallel with the camshaft 42 in the lateral direction. The control shafts 65*a*, 65*b* are concentrically arranged in a state wherein the intake-side control shaft 65*a* is arranged on a left side and the exhaust-side control shaft 65*b* is arranged on a right side. The control shafts 65*a*, 65*b* are individually rotatably supported on the cam holder 35. Eccentric cams 75 are integrally mounted on laterally inner end portions of the respective control shafts 65*a*, 65*b*. The wheel gears 74 are integrally mounted on laterally outer end portions of the respective control shafts 65*a*, 65*b*. The respective eccentric cams 75 are formed in a disc shape and have center axes C5 which are offset in parallel with respect to rotational axes C4 of the respective control shaft 65*a*, 65*b*. One end portion of the arm members 66*a*, 66*b* are rockably fitted on outer peripheries of the eccentric cams 75.

The respective arm members 66*a*, 66*b* are formed in a plate shape and are arranged substantially orthogonal to the camshaft 42. The arm members 66*a*, 66*b* are arranged on laterally inner sides of the cylinder in the same manner as the respective eccentric cams 75 and have one end portions thereof engaged with the corresponding eccentric cams 75. The respective arm members 66*a*, 66*b* extend in a tapered shape from one end portion sides thereof to cylinder-head-24 sides thereof. Distal end portions (another end portions) of the arm members 66*a*, 66*b* are engaged with corresponding holders 67*a* or 67*b*.

Each holder 67*a*, 67*b* includes first and second holder members 76, 77 having a plate shape which are arranged substantially orthogonal to the camshaft 42. Both holder members 76, 77 have one end portions thereof rotatably supported on the camshaft 42 in a penetrating manner in a state wherein the holder members 76, 77 are rotatable relative to the camshaft 42. The holding members 67*a*, 67*b* extend in a tapered shape toward a side opposite to the corresponding engine valves 34*a*, 34*b* from one-end-portion sides thereof. Both holder members 76, 77 have the substantial same shape and are arranged in an overlapped manner as viewed from the camshaft direction (as viewed from the lateral direction).

The first holder members 76 of the respective holders 67*a*, 67*b* are positioned on the laterally inner side of the cylinder in the same manner as the arm members 66*a*, 66*b*, while the second holder members 77 of the respective holders 67*a*, 67*b* are positioned on the laterally outer side of the cylinder. On portions in the vicinity of one end portion of the first holder members 76 of the respective holders 67*a*, 67*b* and on the head cover 25 side, connecting portions 78 for connecting the holders 67*a*, 67*b* with corresponding arm members 66*a* or 66*b* are provided in a projecting manner. Both the holder members 76, 77 are arranged with a predetermined distance therebetween so as to sandwich the drive cam 42*a* or 42*b* and the rotational cam 45*a* or 45*b* therebetween.

An intermediate spacer 81 and a distal end spacer 82 are respectively held between intermediate portions of both holder members 76, 77 and between the distal end portions (another end portions) of both holder members 76, 77. One end portions of the sub-rocker arms 43*a*, 43*b* are rockably supported on a laterally inner side of the intermediate spacer 81 by way of the shaft 51. A spring receiving part 83*b*, which faces in an opposed manner a spring receiving portion 83*a* mounted in a projecting manner on the cylinder head 24 side of the rotational cams 45*a*, 45*b*, is arranged on a laterally outer side of the intermediate spacer 81. A coil spring 83*c* is arranged between the spring receiving portion 83*a* and the spring receiving portion 83*b* in a shrinkable manner. See, FIG. 2.

On left and right inner sides of the distal-end spacer 82, spring receiving portions 84*b*, which face spring receiving portions 84*a* mounted on the sub rocker arms 43*a*, 43*b* in the vicinity of the cam roller 52 in a projecting manner, are arranged on a laterally inner side of the distal-end spacer 82. Coil springs 84*c* are provided between these spring receiving portions 84*a*, 84*b* in a shrinkable manner. See, FIG. 2. On left and right outer sides of the distal-end spacer 82, for example, a spring receiving portion 85*b* is arranged which faces a spring receiving portion not shown in the drawing mounted on the cam holder 35. A coil spring 85*c* is provided between the spring receiving portions 85*b* in a shrinkable manner. See, FIG. 2.

As shown in FIG. 3 and FIG. 5, on both left and right sides of the head cover 25, angle sensors 86, such as potentiometers which detect rotational angles of the control shafts 65*a*, 65*b*, are respectively arranged on corresponding sides. Each angle sensor 86 is arranged such that a body 86*a* thereof is arranged outside the valve operating chamber 32 and a rotary shaft 86*b* thereof for detecting an angle is inserted into the inside of the valve operating chamber 32. The rotary shafts 86*b* are engaged with left and right outer end portions of the corresponding control shafts 65*a*, 65*b* in a relatively non-rotatable manner. Detection signals from these angle sensors 86 are inputted into an ECU 87 which performs an operational control of the respective electrically operated motors 62*a*, 62*b*.

As shown in FIG. 5, the ECU 87 includes an air flow meter for detecting an intake air quantity and a crank angle sensor for detecting a piston position and an engine rotational speed. The above-mentioned opening sensor detects an opening (throttle opening) of the throttle valve 26*a* and the like, and controls the operation of the respective electrically operated motors 62*a*, 62*b*. More specifically, the operation of the valve characteristic variable mechanism 61 based on a detection signal from an operational state detection means 88 for detecting an operational state of the engine 20, a detection signal from the above-mentioned angle sensor 86 and the like thus enabling an engine operation with the valve operating characteristic in response to the operation state of the engine 20 or the like.

Next, the manner of operation is explained.

Figure 6:
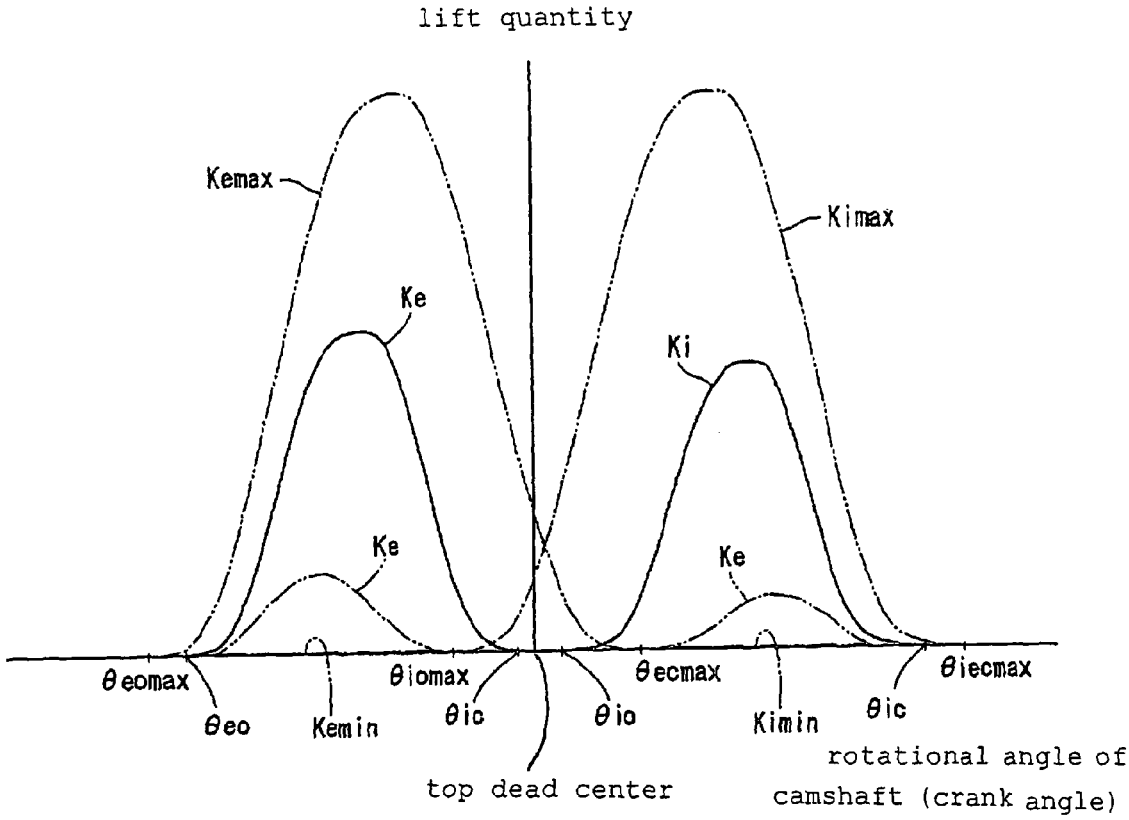
FIG. 6 is a graph showing a valve operating characteristic of the above-mentioned engine, wherein a rotational angle of a camshaft is taken on an axis of abscissas and the lift quantity of an engine valve is taken on an axis of ordinates.

As shown in the graph illustrated in FIG. 6, the operational timings (opening/closing timings) and maximum life quantities of the intake and exhaust valves 34*a*, 34*b* are individually and continuously controlled by the valve characteristic valuable mechanism 61 between the respective maximum valve operating characteristics Kimax, Kemax and the respective minimum valve operating characteristics Kimin, Kemin. Here, the minimum valve operating characteristics Kimin, Kemin in FIG. 6 correspond to a state in which the valve lift quantity is 0 (that is, a valve rest state).

More specifically, with respect to the intake valve 34*a*, for example, when the valve operating characteristic is shifted to the arbitrary small valve operating characteristic Ki from the maximum valve operating characteristic Kimax, the opening timing has an angle thereof continuously delayed from θiomax to θio and, at the same time, the closing timing has an angle thereof continuously and relatively gently advanced from θicmax to θic. Thus, a valve opening period is continuously shortened and, at the same time, a rotational angle of the cam shaft 42 (or a crank angle indicative of a rotational position of the crank shaft) with which the maximum lift quantity is obtained has an angle thereof continuously delayed and, at the same time, the maximum lift quantity is continuously decreased.

On the other hand, with respect to the exhaust valve 34*b*, for example, when the valve operating characteristic is shifted to the arbitrary small valve operating characteristic Ke from the maximum valve operating characteristic Kemax, the opening timing has an angle thereof continuously and relatively gently delayed from θeomax to θeo and, at the same time, a closing timing has an angle thereof continuously advanced from θecmax to θec. Thus, the valve opening period is continuously shortened and, at the same time, a rotational angle of the cam shaft 42 with which the maximum lift quantity is obtained has an angle thereof continuously advanced and, at the same time, the maximum lift quantity is continuously decreased.

Figure 7B:
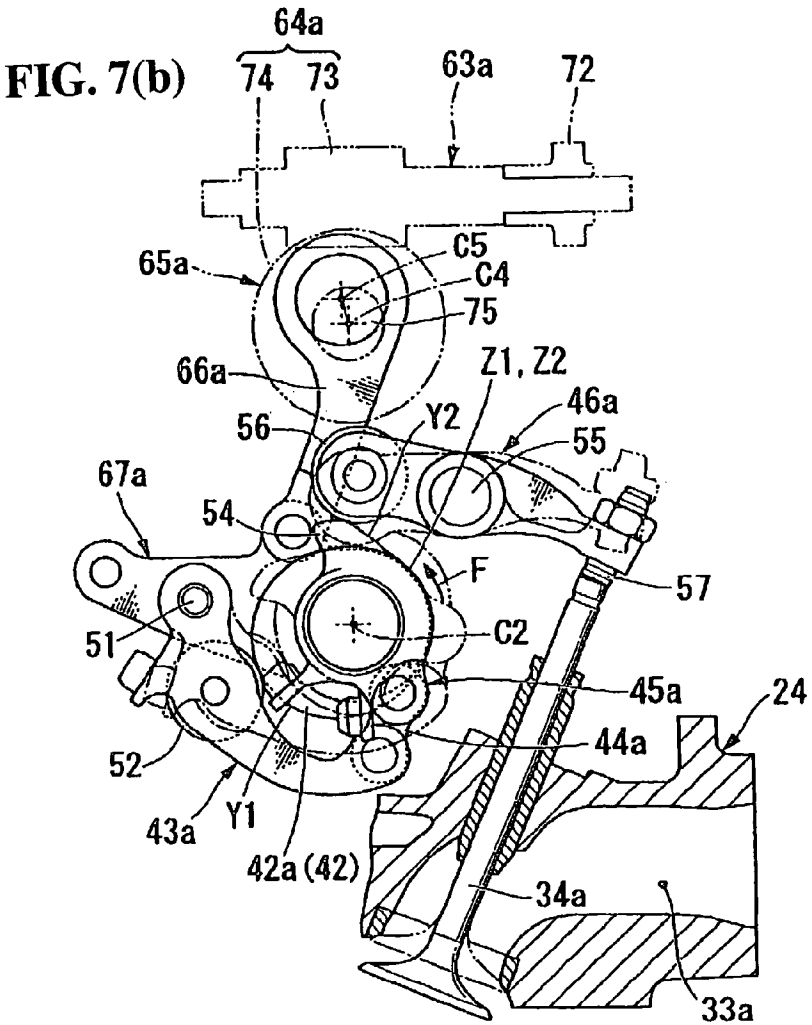
FIGS. 7(*a*) and 7(*b*) are operational explanatory views when an intake valve of the above-mentioned engine assumes the maximum valve operating characteristic, wherein 7(*a*) shows the intake valve in a closed state, and 7(*b*) shows the engine valve in an open state.
Figure 7A:
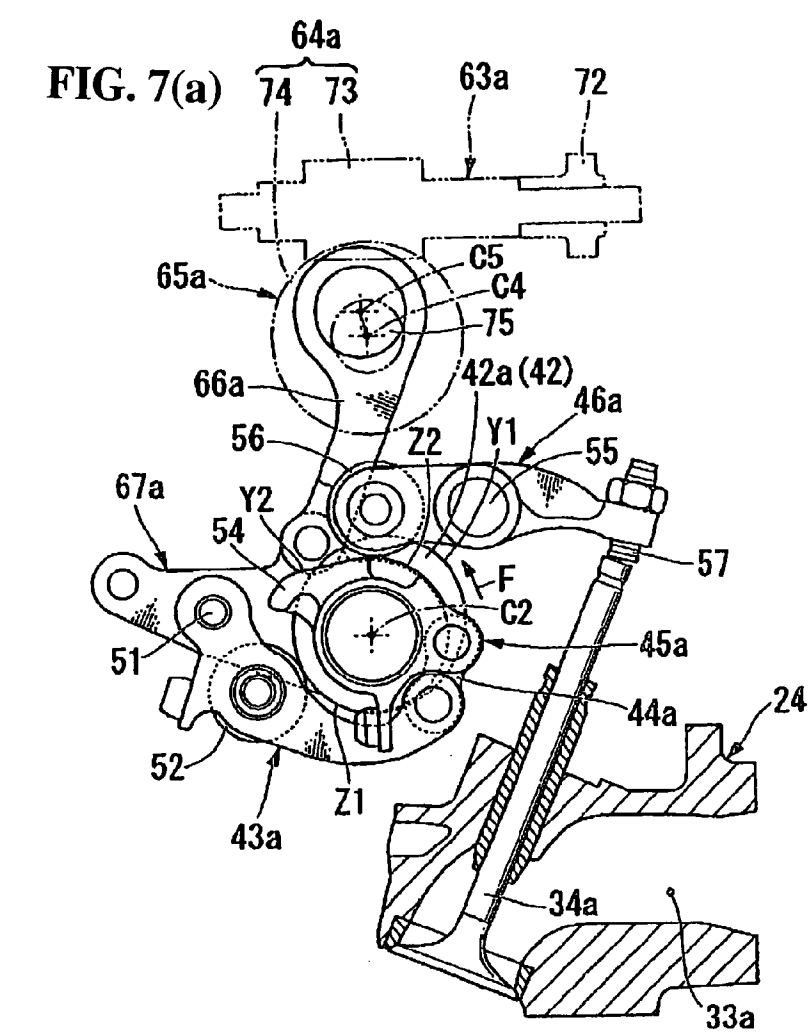

As shown in FIG. 7(*a*), on the intake side of the valve characteristic variable mechanism 61, the control shaft 65*a* is rotated by driving the intake-side electrically operated motor 62*a* by way of the pair of worm gears 64*a* thus pulling up the arm member 66*a* to a movement limit position on an upper side (head cover 25 side) in FIG. 7(*a*). In such a state, the holder 67*a* is rotated to a rotational limit position in the clockwise direction (cam shaft reverse rotation direction) in FIG. 7(*a*) against a spring force of the above-mentioned coil spring 85*c* and, at the same time, the sub rocker arm 43*a* is moved to a movement limit position in the clockwise direction in FIG. 7(*a*). In addition, the rotary cam 45*a* is rotated to the rotational limit position in the clockwise direction in the drawing by way of the link member 44*a*. Thus, the cam crest portion 54 of the rotary cam 45*a* is moved to the movement limit position in the clockwise direction in FIG. 7(*a*), and a lift surface Y2 of the cam crest portion 54 approaches closest to the cam roller 56 (input portion) of the main rocker arm 46*a*.

In such a state, when the cam shaft 42 is rotatably driven and, as shown in FIG. 7(*b*), the cam roller 52 of the sub rocker arm 43*a* moves over a lift surface Y1 of the intake drive cam 42*a*, the sub rocker arm 43*a* is rocked against a spring force of the coil spring 84*c* thus rotating the rotary cam 45*a* by way of the link member 44*a* against a spring force of the coil spring 83*c* whereby the main rocker arm 46*a* is rocked by the lift surface Y2 of the rotary cam 45*a* thus opening the engine valve 34*a*. The valve operating characteristic assumes the above-mentioned maximum valve operating characteristic Kimax in which the opening timing of the intake valve 34*a* assumes the most advanced angle and the closing timing of the intake valve 34*a* assumes the most delayed angle and, at the same time, the rotational angle of the cam shaft 42 with which the maximum lift quantity is obtained assumes the most advanced angle, and the maximum lift quantity becomes maximum.

Figure 8B:
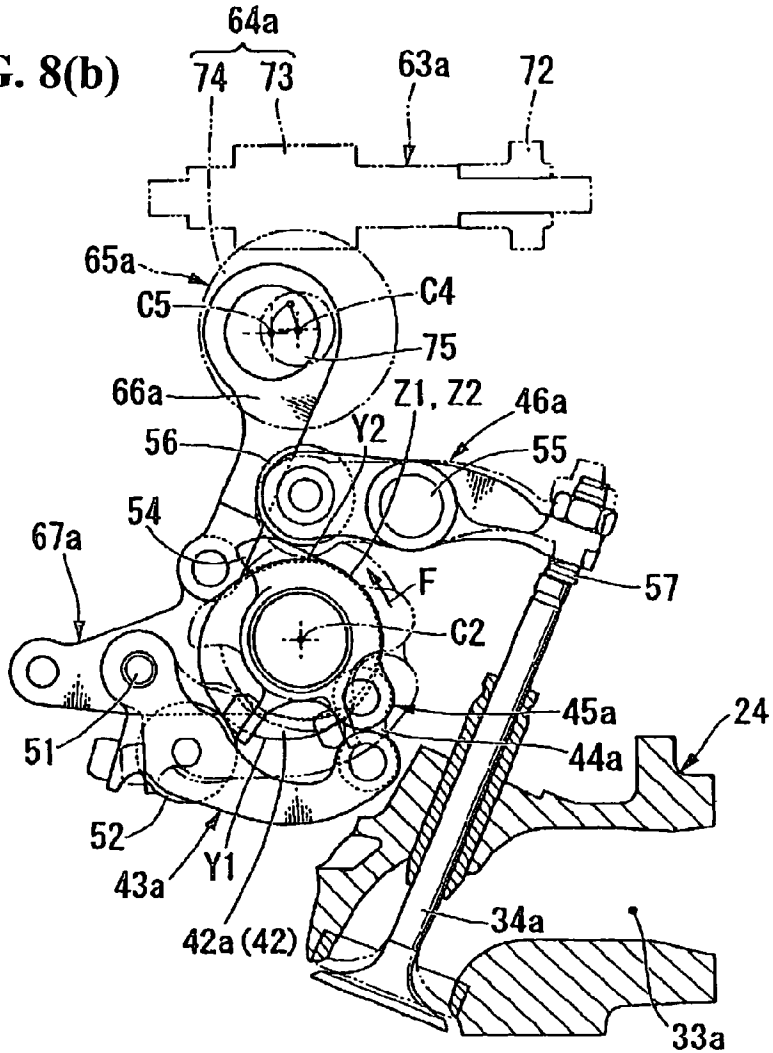
FIGS. 8(*a*) and 8(*b*) are operational explanatory views when the intake valve of the above-mentioned engine assumes the minimum valve operating characteristic, wherein 8(*a*) shows the engine valve in a closed state, and 8(*b*) shows the engine valve in an open state.
Figure 8A:
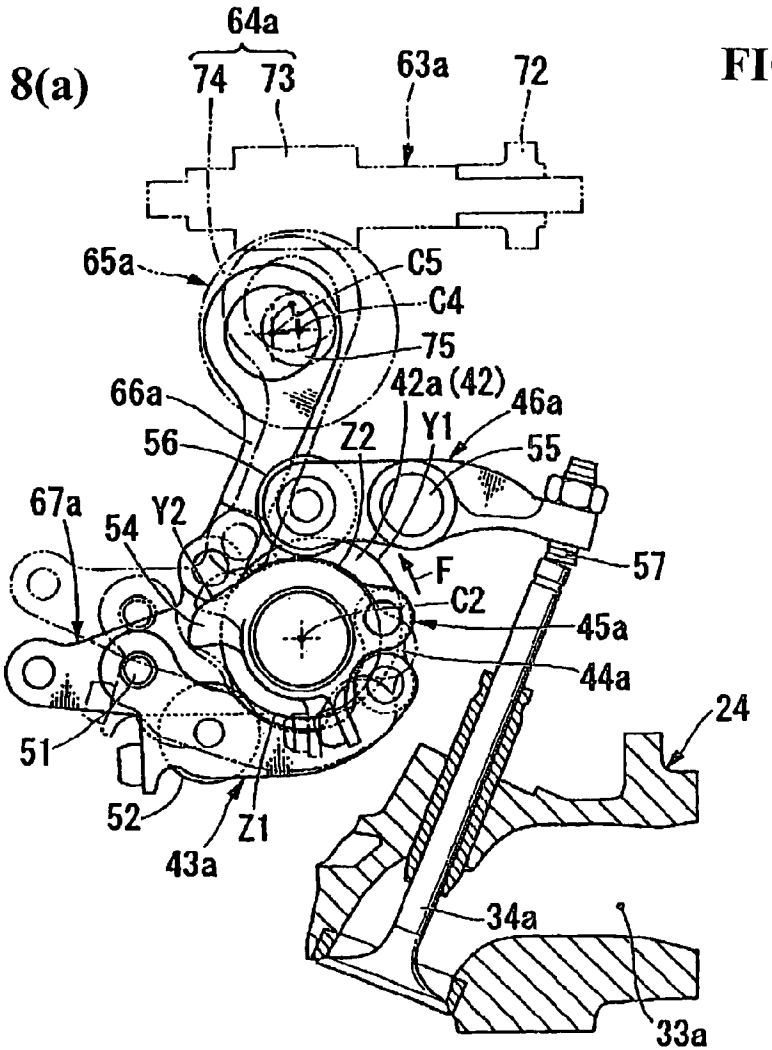

Further, as shown in FIG. 8(*a*), when the arm member 66*a* is pulled down to an arbitrary moved position at a lower portion (cylinder head 24 side) in the drawing by driving the intake-side electrically operated motor 62*a*, the sub rocker arm 43*a* is moved to an arbitrary moved position in the counterclockwise direction (normal rotating direction of the cam shaft) in the drawing and, at the same time, the cam crest portion 54 of the rotary cam 45*a* is moved to an arbitrary moved position in the counterclockwise direction in the drawing, and the lift surface Y2 of the cam crest portion 54 is separated from the cam roller 56 of the main rocker arm 46*a*.

In such a state, when the cam shaft 42 is driven and, as shown in FIG. 8(*b*), the cam roller 52 of the sub rocker arm 43*a* moves over a lift surface Y1 of the intake drive cam 42*a*, in the same manner as the above-mentioned operation, the sub rocker arm 43*a* is rocked to rotate the rotary cam 45*a*, and the main rocker arm 46*a* is rocked by the lift surface Y2 of the rotary cam 45*a* thus opening the engine valve 34*a*. The valve operating characteristic assumes the above-mentioned small valve operating characteristic Ki in which the opening timing of the intake valve 34*a* assumes the delayed angle and the closing timing of the intake valve 34*a* assumes the advanced angle and, at the same time, the rotational angle of the cam shaft 42 with which the maximum lift quantity is obtained assumes the delayed angle and the maximum lift quantity is decreased.

Figure 9B:
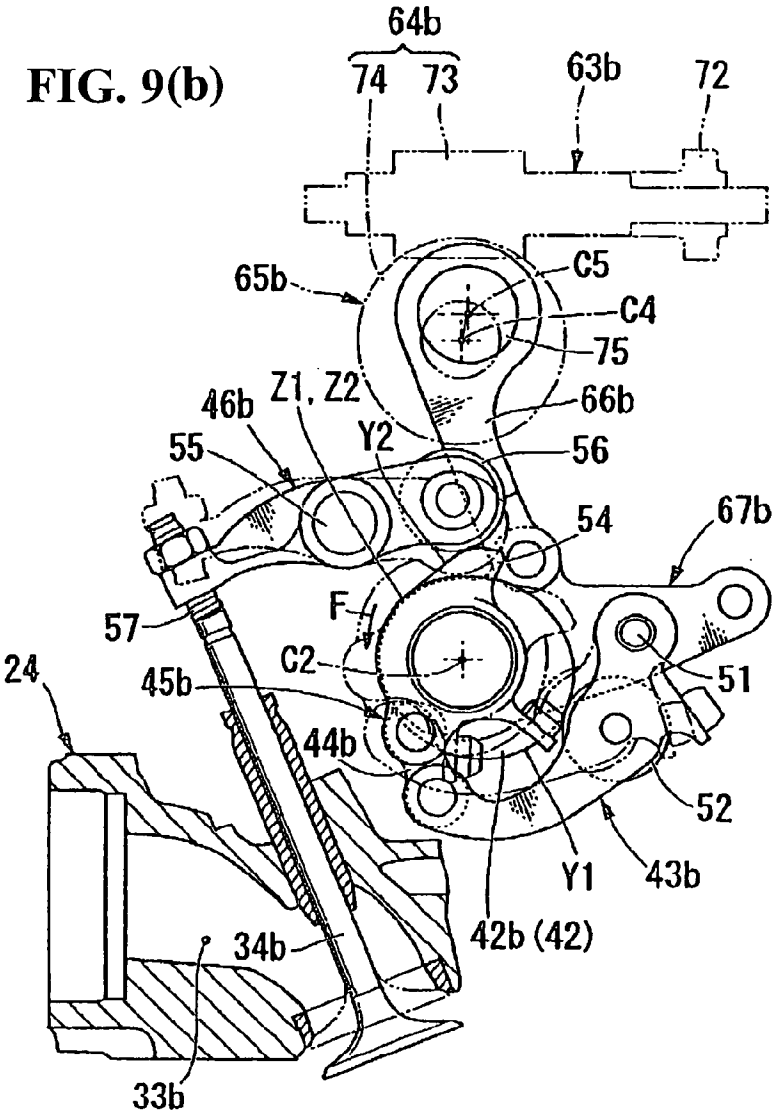
FIGS. 9(*a*) and 9(*b*) are operational explanatory views when an exhaust valve of the above-mentioned engine assumes the maximum valve operating characteristic, wherein 9(*a*) shows the engine valve in a closed state, and 9(*b*) shows the engine valve in an open state.
Figure 9A:
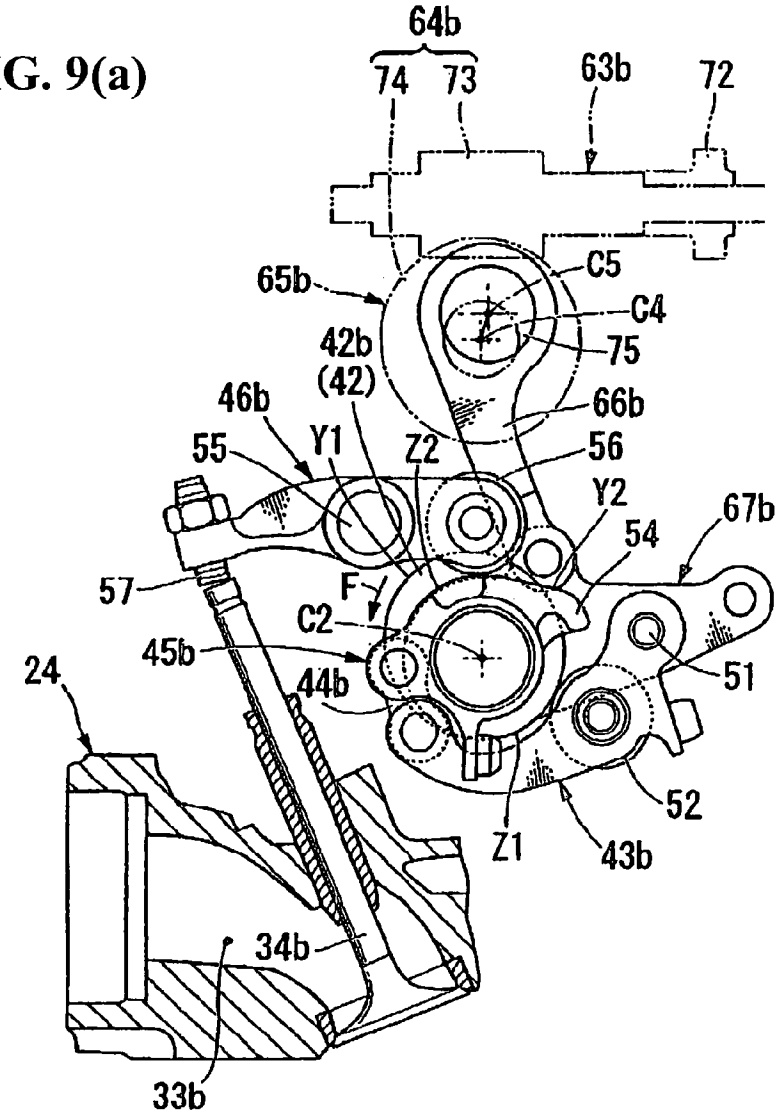

On the other hand, as shown in FIG. 9(*a*), on the exhaust side of the valve characteristic variable mechanism 61, the control shaft 65*b* is rotated by driving the exhaust-side electrically operated motor 62*b* by way of the pair of worm gears 64*b* thus pulling up the arm member 66*b* to a movement limit position on an upper side (head cover 25 side) in FIG. 9(*a*). In such a state, the holder 67*b* is rotated to a rotation limit position in the counterclockwise direction (cam shaft normal rotation direction) in FIG. 9(*a*) against a spring force of the above-mentioned coil spring 85*c* and, at the same time, the sub rocker arm 43*b* is moved to a movement limit position in the counterclockwise direction in FIG. 9(*a*), and the rotary cam 45*b* is rotated to the rotational limit position in the counterclockwise direction in FIG. 9(*a*) by way of the link member 44*b*. Here, the cam crest portion 54 of the rotary cam 45*b* is moved to the movement limit position in the counterclockwise direction in FIG. 9(*a*), and a lift surface Y2 of the cam crest portion 54 approaches closest to the cam roller 56 (input portion) of the main rocker arm 46*b*.

In such a state, when the cam shaft 42 is rotatably driven and, as shown in FIG. 9(*b*), the cam roller 52 of the sub rocker arm 43*b* gets over a lift surface Y1 of the intake drive cam 42*b*, the sub rocker arm 43*b* is rocked against a spring force of the above-mentioned coil spring 84*c* thus rotating the rotary cam 45*b* by way of the link member 44*b* against a spring force of the above-mentioned coil spring 83*c* whereby the main rocker arm 46*b* is rocked by the lift surface Y2 of the rotary cam 45*b* thus opening the engine valve 34*b*. The valve operating characteristic assumes the above-mentioned maximum valve operating characteristic Kemax in which the opening timing of the exhaust valve 34*b* assumes the most advanced angle and the closing timing of the exhaust valve 34*a* assumes the most delayed angle and, at the same time, the rotational angle of the cam shaft 42 with which the maximum lift quantity is obtained assumes the most delayed angle, and the maximum lift quantity becomes maximum.

Figure 10B:
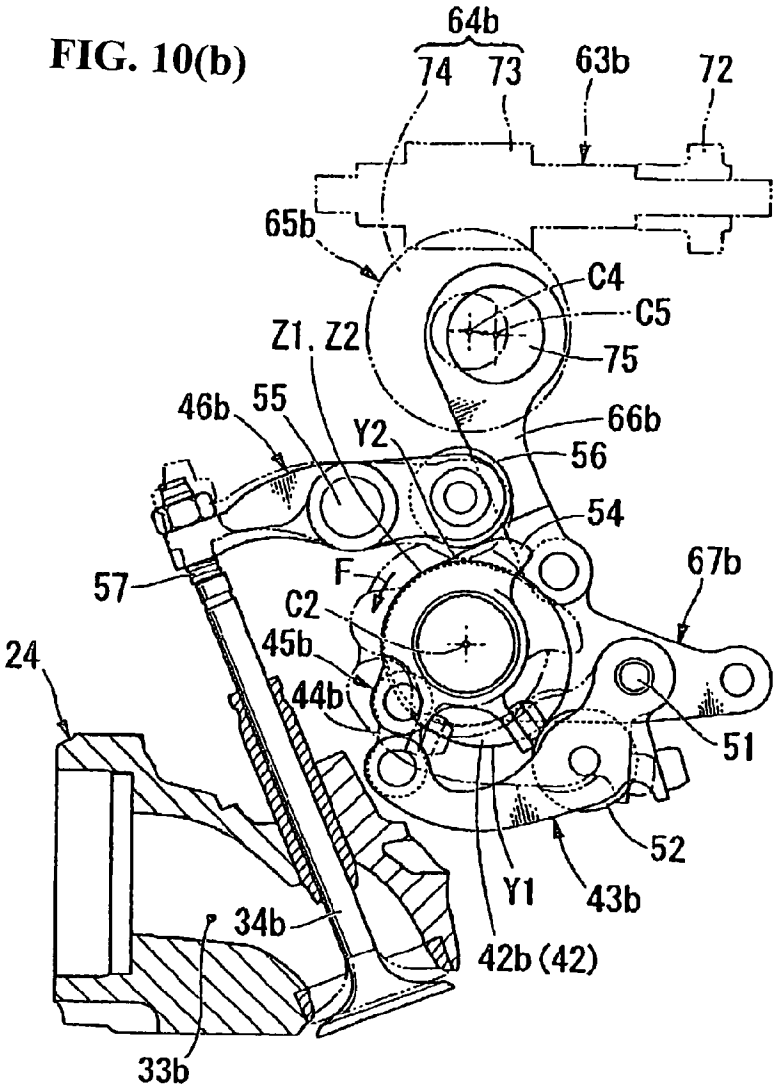
FIGS. 10(*a*) and 10(*b*) are operational explanatory views when the exhaust valve of the above-mentioned engine assumes the minimum valve operating characteristic, wherein 10(*a*) shows the engine valve in a closed state, and 10(*b*) shows the engine valve in an open state.
Figure 10A:
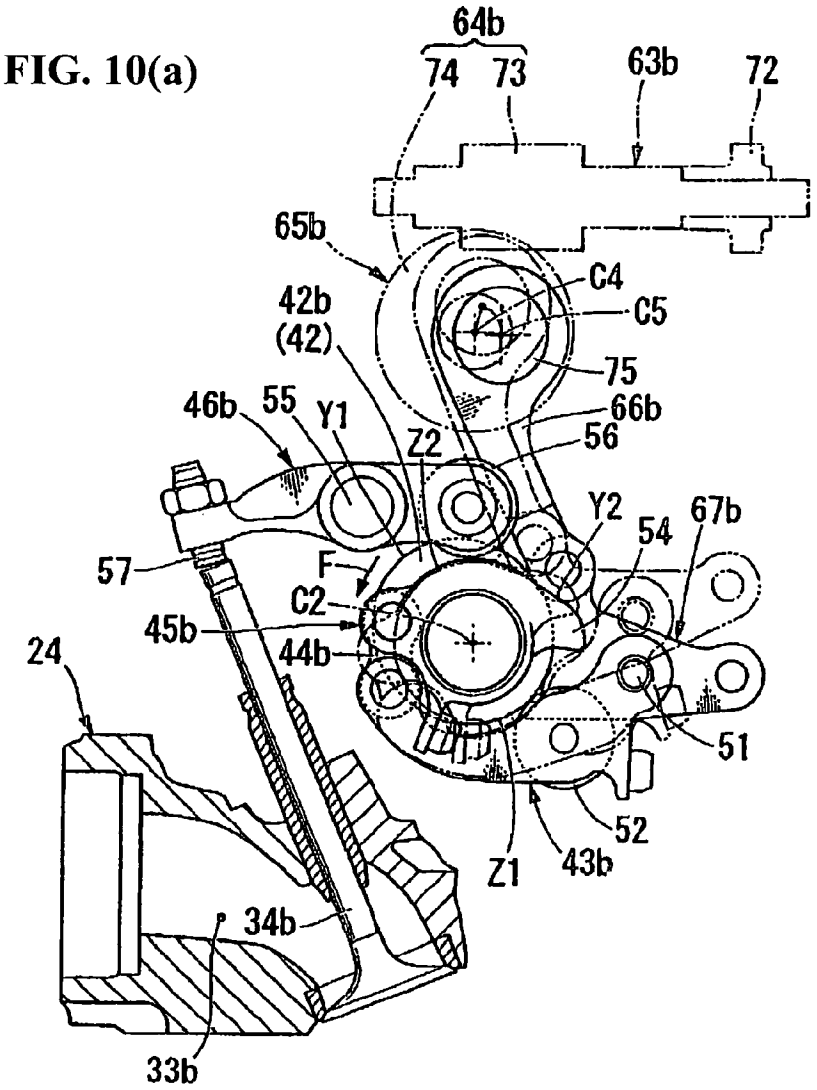

Further, as shown in FIG. 10(*a*), when the arm member 66*b* is pulled down to an arbitrary moved position at a lower portion (cylinder head 24 side) in FIG. 10(*a*) by driving the exhaust-side electrically operated motor 62*b*, the cam roller 52 (input end) of the sub rocker arm 43*b* is moved to an arbitrary moved position in the clockwise direction (reverse rotating direction of the cam shaft) in FIG. 10(*a*) and, at the same time, the cam crest portion 54 of the rotary cam 45*b* is moved to an arbitrary moved position in the clockwise direction in FIG. 10(*a*), and the lift surface Y2 of the cam crest portion 54 is separated from the cam roller 56 of the main rocker arm 46*b*.

In such a state, when the cam shaft 42 is rotatably driven and, as shown in FIG. 10(*b*), the cam roller 52 of the sub rocker arm 43*b* gets over a lift surface Y1 of the exhaust drive cam 42*b*, in the same manner as the above-mentioned operation, the sub rocker arm 43*b* is rocked to rotate the rotary cam 45*b*, and the main rocker arm 46*b* is rocked by the lift surface Y2 of the rotary cam 45*b* thus opening the engine valve 34*b*. The valve operating characteristic assumes the above-mentioned small valve operating characteristic Ke in which the opening timing of the exhaust valve 34*b* assumes the delayed angle and the closing timing of the exhaust valve 34*b* assumes the advanced angle and, at the same time, the rotational angle of the cam shaft 42 with which the maximum lift quantity is obtained assumes the delayed angle and the maximum lift quantity is decreased.

Such a variable valve operating device 40 is controlled by the above-mentioned ECU 87 in response to an operational state of the engine 20. That is, when the engine 20 is operated in a low load region, the lift quantities of the intake and exhaust valves 34*a*, 34*b* are made small, and the opening timing assumes a delayed angle and, at the same time, the closing timing assumes an advanced angle. Due to such a control, a valve overlapping quantity is decreased thus enabling the acquisition of the enhancement of the fuel economy and the stable combustion. On the other hand, when the engine 20 is operated in a middle or high load region, the lift quantities of the intake and exhaust valves 34*a*, 34*b* are made large, and the opening timing assumes an advanced angel and, at the same time, the closing timing assumes a delayed angle. Due to such a control, the valve overlapping quantity is increased. Thus, the intake charging efficiency is enhanced thus realizing the acquisition of a sufficient output and, at the same time, the fuel economy performance and the exhaust performance attributed to an internal EGR (Exhaust Gas Recirculation) can be enhanced.

As has been explained heretofore, the engine 20 according to the above-mentioned embodiment is mounted on the motorcycle 1, and includes a cylinder head 24 which is joined to the cylinder body 23 and forms the combustion chamber 31 and the valve operating chamber 32 therein, and the variable valve operating device 40 having the valve characteristic variable mechanism 61 which controls the valve operating characteristic of the engine valves constituted of the intake valve 34*a* and the exhaust valve 34*b*. Here, the above-mentioned valve characteristic variable mechanism 61 includes the electrically operated motors 62*a*, 62*b* which change the operational timings and the lift quantities of the above-mentioned engine valves 34*a*, 34*b*, the electrically operated motors 62*a*, 62*b* are arranged outside the above-mentioned valve operating chamber 32 and, at the same time, the electrically operated motors 62*a*, 62*b* are arranged close to the throttle body 26 on the cylinder intake side.

Due to such a constitution, it is possible to arrange the electrically operated motors 62*a*, 62*b* which are liable to easily become bulky by effectively making use of a space which is liable to be formed around the intake system parts, particularly, around the throttle body 26 which connects the cylinder head 24 and the air cleaner. Thus, even when the engine 20 includes a plurality of electrically operated motors 62*a*, 62*b*, the engine can be miniaturized as a whole and, at the same time, the cooling property of the electrically operated motors 62*a*, 62*b* can be enhanced.

Further, in the above-mentioned engine 20, a drive axis C3 of the above-mentioned electrically operated motors 62*a*, 62*b* is arranged substantially perpendicular to the cylinder axis C1. Thus, the projection of the electrically operated motors 62*a*, 62*b* from the cylinder head 24 in the cylinder axis C1 direction can be suppressed whereby even when the engine 20 includes the plurality of electrically operated motors 62*a*, 62*b*, it is possible to miniaturize the cylinder as a whole in the cylinder axis C1 direction.

Further, in the above-mentioned engine 20, by providing the plurality of electrically operated motors 62*a*, 62*b* for individually controlling the above-mentioned intake valve 34*a* and the exhaust valve 34*b*, the operational timings and the lift quantities of the intake valve 34*a* and the exhaust valve 34*b* can be individually changed thus effectively making use of the EGR combustion region which exhibits favorable fuel economy.

More particularly, as viewed along the above-mentioned cylinder axis C1, by arranging the cylinder intake passage in a space surrounded by the plurality of electrically operated motors 62*a*, 62*b*, it is possible to efficiently arrange the respective electrically operated motors 62*a*, 62*b* and the cylinder intake passage.

Further, in the above-mentioned engine 20, the valve characteristic variable mechanism 61 includes the rotatable control shafts 65*a*, 65*b* for changing the operational timings and the lift quantities of the above-mentioned engine valves 34*a*, 34*b*, and the angular sensor 86 for detecting the rotational angles of the control shafts 65*a*, 65*b* are formed on one end portions of the control shafts 65*a*, 65*b*. Thus, by directly detecting the rotational angles of the control shafts 65*a*, 65*b* using the angular sensors 86, it is possible to easily adjust the operational timings and lift quantities of the engine valves 34*a*, 34*b*.

Further, in the above-mentioned engine 20, by driving the above-mentioned electrically operated motors 62*a*, 62*b* to control the operational timings and the lift quantities of the above-mentioned engine valves 34*a*, 34*b* in response to the throttle opening and the engine rotational speed, it is possible to set a proper EGR combustion zone in response to the throttle opening and the engine rotational speed and, at the same time, the fuel economy can be enhanced by optimizing the EGR combustion region.

Further, in the electronic throttle type engine 20, by obtaining the above-mentioned throttle opening based on an output of the opening sensor of the throttle valve 26*a*, it is possible to realize a more accurate engine control and, at the same time, an increase in the number of parts can be suppressed.

The present invention is not limited to the above-mentioned embodiment and, for example, the valve characteristic variable mechanism may control the valve operating characteristic of either one of the intake/exhaust valves, and one of the operational timings and the lift quantities of the intake/exhaust valves may be changed. Further, as the drive source (actuator) of the valve characteristic variable mechanism, a hydraulic motor or cylinder which uses a fluid pressure or the like may be used in place of the electrically operated motor.

Further, the present invention may be applicable to an engine which mechanically drives a throttle valve by way of a cable or the like in place of the electronic throttle type engine.

Further, the present invention may be also applicable to an engine which includes a cylinder inclined forwardly, rearwardly or in the lateral direction in place of the substantially horizontal cylinder. Further, the present invention may be applicable to an engine in which at least one of the intake and exhaust valves is constituted of a plurality of valves. Further, the present invention may be applicable to various types of reciprocation engines such as a parallel or V-type plural-cylinder engine or a vertically-installed engine which has a crankshaft thereof arranged along the longitudinal direction of a vehicle.

Further, the constitution of the above-mentioned embodiment is one example of the present invention, and it is needless to say that the present invention is not limited to the motorcycle and is applicable to a three-wheeled or four-wheeled vehicle, and various modifications are conceivable without departing from the gist of the present invention.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. An internal combustion engine having a variable valve operating device, the internal combustion engine being mounted on a vehicle and comprising:

a cylinder head joined to a cylinder body and forming a combustion chamber and a valve operating chamber therein;

a variable valve operating device having a valve characteristic variable mechanism for controlling a valve operating characteristic of at least one engine valve out of an intake valve and an exhaust valve; and a camshaft arranged between stems of the intake valve and the exhaust valve, wherein the valve characteristic variable mechanism includes an actuator for changing at least one of an operational timing and a lift quantity of the at least one engine valve, said actuator being arranged outside the valve operating chamber;

wherein the actuator is arranged on a cylinder intake side and, at the same time, is arranged close to a throttle body.

2. The internal combustion engine having a variable valve operating device according to claim 1, wherein the valve characteristic variable mechanism includes a control shaft which is rotated to change at least one of the operational timing and the lift quantity of the at least one engine valve, and a sensor for detecting a rotational angle is mounted on one end portion of the control shaft.

3. The internal combustion engine having a variable valve operating device according to claim 2, wherein at least one of the operational timing and the lift quantity of the at least one engine valve is controlled in response to a throttle opening and an engine rotational speed.

4. The internal combustion engine having a variable valve operating device according to claim 2, wherein the actuator is driven in response to a throttle opening and an engine rotational speed.

5. The internal combustion engine having a variable valve operating device according to claim 1, wherein at least one of the operational timing and the lift quantity of the at least one engine valve is controlled in response to a throttle opening and an engine rotational speed.

6. The internal combustion engine having a variable valve operating device according to claim 5, wherein the actuator is driven in response to a throttle opening and an engine rotational speed.

7. The internal combustion engine having a variable valve operating device according to claim 5, wherein the throttle opening is obtained based on an output of an opening sensor of an electronic throttle.

8. The internal combustion engine having a variable valve operating device according to claim 1, wherein the actuator is driven in response to a throttle opening and an engine rotational speed.

9. The internal combustion engine having a variable valve operating device according to claim 8, wherein the throttle opening is obtained based on an output of an opening sensor of an electronic throttle.

10. An internal combustion engine having a variable valve operating device, the internal combustion engine being mounted on a vehicle and comprising:

a cylinder head joined to a cylinder body and forming a combustion chamber and a valve operating chamber therein;

a variable valve operating device having a valve characteristic variable mechanism for controlling a valve operating characteristic of at least one engine valve out of an intake valve and an exhaust valve; and an intake valve rocker arm having one end connected to an upper end of an intake valve stem, and an exhaust valve rocker arm having one end connected to an upper end of an exhaust valve stem, wherein each of the intake valve rocker arm and the exhaust valve rocker arm has an intermediate portion supported on a respective one of a pair of shafts disposed on opposite sides on a camshaft, the shafts extending parallel to the camshaft, wherein each of the intake valve rocker arm and the exhaust valve rocker arm extends outwardly from the respective shaft at an angle that is slanted toward the other of the intake valve rocker arm and the exhaust valve rocker arm, wherein the valve characteristic variable mechanism includes an actuator for changing at least one of an operational timing and a lift quantity of the at least one engine valve, and the actuator is arranged outside the valve operating chamber;

wherein a drive axis of the actuator is arranged substantially orthogonal to a cylinder axis.

11. The internal combustion engine having a variable valve operating device according to claim 10, wherein the valve characteristic variable mechanism includes a control shaft which is rotated to change at least one of the operational timing and the lift quantity of the at least one engine valve, and a sensor for detecting a rotational angle is mounted on one end portion of the control shaft.

12. The internal combustion engine having a variable valve operating device according to claim 11, wherein at least one of the operational timing and the lift quantity of the at least one engine valve is controlled in response to a throttle opening and an engine rotational speed.

13. The internal combustion engine having a variable valve operating device according to claim 10, wherein at least one of the operational timing and the lift quantity of the at least one engine valve is controlled in response to a throttle opening and an engine rotational speed.

14. The internal combustion engine having a variable valve operating device according to claim 13, wherein the actuator is driven in response to a throttle opening and the engine rotational speed.

15. The internal combustion engine having a variable valve operating device according to claim 13, wherein the throttle opening is obtained based on an output of an opening sensor of an electronic throttle.

16. The internal combustion engine having a variable valve operating device according to claim 10, wherein the actuator is driven in response to the to a throttle opening and an engine rotational speed.

17. The internal combustion engine having a variable valve operating device according to claim 16, wherein the throttle opening is obtained based on an output of an opening sensor of an electronic throttle.

18. The internal combustion engine having a variable valve operating device according to claim 10, wherein the camshaft is arranged between the stems of the intake valve and the exhaust valve.

19. An internal combustion engine having a variable valve operating mechanism, the internal combustion engine being mounted on a vehicle and comprising:

a cylinder head joined to a cylinder body and forming a combustion chamber and a valve operating chamber therein; and a variable valve operating device having a valve characteristic variable mechanism for controlling valve operating characteristics of engine valves constituting of an intake valve and an exhaust valve, wherein the valve characteristic variable mechanism includes an actuator for changing at least one of operational timing and a lift quantity of the engine valves, and the actuator is arranged outside the valve operating chamber, wherein the actuator is constituted of a plurality of actuators, each having an electric motor for individually controlling the corresponding intake valve and the exhaust valve, and a cylinder intake passage is arranged in a space surrounded by the plurality of actuators as viewed in the direction of the cylinder axis.

20. The internal combustion engine having a variable valve operating device according to claim 19, wherein the valve characteristic variable mechanism includes a pair of control shafts which are rotated to change at least one of the operational timing and the lift quantity of the engine valves, and a sensor for detecting a rotational angle is mounted on one end portion of each of the control shafts, wherein each of the actuators includes a worm gear for directly meshing with a gear of the corresponding control shaft.

21. The internal combustion engine having a variable valve operating device according to claim 20, wherein at least one of the operational timing and the lift quantity of the engine valves is controlled in response to a throttle opening and an engine rotational speed.

22. The internal combustion engine having a variable valve operating device according to claim 20, wherein the actuators are driven in response to a throttle opening and an engine rotational speed.

23. The internal combustion engine having a variable valve operating device according to claim 19, wherein at least one of the operational timing and the lift quantity of the engine valves is controlled in response to a throttle opening and an engine rotational speed.

24. The internal combustion engine having a variable valve operating device according to claim 23, wherein the actuators are driven in response to the throttle opening and the engine rotational speed.

25. The internal combustion engine having a variable valve operating device according to claim 23, wherein the throttle opening is obtained based on an output of an opening sensor of an electronic throttle.

26. The internal combustion engine having a variable valve operating device according to claim 19, wherein the actuators are driven in response to a throttle opening and an engine rotational speed.

27. The internal combustion engine having a variable valve operating device according to claim 19, further comprising a camshaft arranged between stems of the intake valve and the exhaust valve.

* * * * *